US009909216B2

(12) United States Patent
Brunner et al.

(10) Patent No.: US 9,909,216 B2
(45) Date of Patent: Mar. 6, 2018

(54) PLATING BATH COMPOSITIONS FOR ELECTROLESS PLATING OF METALS AND METAL ALLOYS

(71) Applicant: Atotech Deutschland GmbH, Berlin (DE)

(72) Inventors: Heiko Brunner, Berlin (DE); Lars Kohlmann, Berlin (DE); Sengül Karasahin, Berlin (DE); Matthias Dammasch, Berlin (DE); Simon Pape, Berlin (DE); Sandra Lucks, Berlin (DE)

(73) Assignee: Atotech Deutschland GmbH, Berlin (DE)

( * ) Notice: Subject to any disclaimer, the term of this patent is extended or adjusted under 35 U.S.C. 154(b) by 0 days.

(21) Appl. No.: 15/526,771

(22) PCT Filed: Dec. 4, 2015

(86) PCT No.: PCT/EP2015/078679
§ 371 (c)(1),
(2) Date: May 15, 2017

(87) PCT Pub. No.: WO2016/096480
PCT Pub. Date: Jun. 23, 2016

(65) Prior Publication Data

US 2017/0327954 A1 Nov. 16, 2017

(30) Foreign Application Priority Data

Dec. 16, 2014 (EP) ..... 14198380

(51) Int. Cl.
*C23C 18/50* (2006.01)
*C23C 18/36* (2006.01)
*C23C 18/40* (2006.01)

(52) U.S. Cl.
CPC ..... *C23C 18/50* (2013.01); *C23C 18/36* (2013.01); *C23C 18/40* (2013.01); *C23C 18/405* (2013.01)

(58) Field of Classification Search
CPC ..... C23C 18/50; C23C 18/36; C23C 18/40; C23C 18/405
USPC ..... 106/1.22, 1.23, 1.25, 1.26, 1.27
See application file for complete search history.

(56) References Cited

U.S. PATENT DOCUMENTS

| | | | | |
|---|---|---|---|---|
| 4,617,205 | A | 10/1986 | Darken | |
| 4,629,636 | A | 12/1986 | Courduvelis et al. | |
| 6,712,948 | B1 * | 3/2004 | Naruskevicius | C23C 18/2006 205/159 |
| 7,220,296 | B1 | 5/2007 | Chowdhury et al. | |
| 8,961,670 | B2 * | 2/2015 | Bera | C23C 18/50 106/1.22 |
| 9,175,399 | B2 * | 11/2015 | Brunner | C23C 18/50 |
| 9,504,161 | B2 * | 11/2016 | Sparing | C23F 1/18 |
| 9,551,080 | B2 * | 1/2017 | Brunner | C25D 3/38 |
| 2005/0161338 | A1 | 7/2005 | Fang et al. | |
| 2007/0167857 | A1 | 7/2007 | Causevic | |
| 2008/0223253 | A1 | 9/2008 | Song et al. | |
| 2012/0213914 | A1 | 8/2012 | Ivanov et al. | |
| 2014/0087560 | A1 | 3/2014 | Mevellec et al. | |
| 2014/0353160 | A1 | 12/2014 | Bibber | |
| 2015/0345027 | A1 * | 12/2015 | Janik | C23C 18/36 106/1.22 |

FOREIGN PATENT DOCUMENTS

| | | |
|---|---|---|
| EP | 1001052 | 5/2000 |
| EP | 2270255 | 1/2011 |
| EP | 2009142 | 5/2013 |
| EP | 2671969 | 11/2013 |
| JP | 609880 | 1/1985 |
| JP | 2007254793 | 10/2007 |
| WO | 2011003116 | 1/2011 |
| WO | 2013013941 | 1/2013 |
| WO | 2013113810 | 8/2013 |
| WO | 2013135396 | 9/2013 |

OTHER PUBLICATIONS

PCT/EP2015/078679; PCT International Search Report and Written Opinion of the International Searching Authority dated Mar. 2, 2016.

* cited by examiner

*Primary Examiner* — Helene Klemanski
(74) *Attorney, Agent, or Firm* — Renner, Otto, Boisselle & Sklar, LLP

(57) ABSTRACT

The present invention relates to additives which may be employed in electroless metal and metal alloy plating baths and a process for use of said plating baths. Such additives reduce the plating rate and increase the stability of electroless plating baths and therefore, such electroless plating baths are particularly suitable for the deposition of said metal or metal alloys into recessed structures such as trenches and vias in printed circuit boards, IC substrates and semiconductor substrates. The electroless plating baths are further useful for metallization of display applications.

19 Claims, No Drawings

PLATING BATH COMPOSITIONS FOR ELECTROLESS PLATING OF METALS AND METAL ALLOYS

The present application is a U.S. National Stage Application based on and claiming benefit and priority under 35 U.S.C. § 371 of International Application No. PCT/EP2015/078679, filed 04 Dec. 2015, which in turn claims benefit of and priority to European Application No. 14198380.9 filed 16 Dec. 2014, the entirety of both of which is hereby incorporated herein by reference.

FIELD OF THE INVENTION

The present invention relates to additives suitably used in electroless metal plating baths, electroless plating baths using said additives for electroless plating of metals such as copper, nickel and cobalt as well as metal alloys such as nickel-phosphorous and cobalt-tungsten-phosphorous alloys.

BACKGROUND OF THE INVENTION

The deposition of metals onto surfaces has a long tradition in the art. This deposition can be achieved by means of electrolytic or electroless plating of metals. Even though these plating techniques have been used for many decades there are still many technical challenges unsolved. One such unresolved challenge is the deposition of metals into small cavities without producing too much over-plating.

The deposition of metals or metal alloys into recessed structures such as vias and trenches in the manufacturing of printed circuit boards, IC substrates and semiconductors is mostly achieved by using the so-called dual damascene process. Trenches and vias are etched into the dielectric prior to the deposition of barrier layers, typically nitrides of titanium or tantalum, followed by electrolytic copper filling of the recessed structures and subsequent chemical-mechanical planarization (CMP). Upon decreasing the size of such trenches and vias, however, high plating rates result in too much over-plating of the deposited metal which then have to be removed by a costly CMP and/or chemical etching step. This increases the number of process steps and the waste produced in the overall process, both of which is highly undesirable. Furthermore, electrolytic copper deposits often contain voids which increase the resistivity of interconnects.

An alternative to electrolytic deposition of metals is electroless plating thereof. Electroless plating is the controlled autocatalytic deposition of a continuous film of metal without the assistance of an external supply of electrons. Non-metallic surfaces may be pretreated to make them receptive or catalytic for deposition. All or selected portions of a surface may suitably be pretreated. The main components of electroless metal baths are the metal salt, a complexing agent, a reducing agent, and, as optional ingredients, an alkaline, and additives, as for example stabilising agents. Complexing agents (also called chelating agents in the art) are used to chelate the metal being deposited and prevent the metal from being precipitated from solution (i.e. as the hydroxide and the like). Chelating metal renders the metal available to the reducing agent which converts the metal ions to metallic form. A further form of metal deposition is immersion plating. Immersion plating is another deposition of metal without the assistance of an external supply of electrons and without chemical reducing agent. The mechanism relies on the substitution of metals from an underlying substrate for metal ions present in the immersion plating solution. In the context of the present invention electroless plating is to be understood as autocatalytic deposition with the aid of a chemical reducing agent (referred to a "reducing agent" herein).

In order to adjust the properties of the electroless plating bath and the metal or metal alloy deposit to be formed when using such an electroless plating bath, additives are added to the electroless plating bath in order to improve the properties both the electroless plating bath and the formed metal or metal alloy deposit.

β-amino acids or amides derived therefrom as stabilising agents for electroless plating baths are known from WO 2011/003116. However, such β-amino acids do not alter the plating rate (see Application Example 1).

U.S. Pat. No. 7,220,296 B1 discloses a process for the electroless deposition of copper into recessed structures of integrated circuits to form interconnects. Additives such as polyethyleneglycols may be added to the disclosed electroless copper plating bath to more selectively deposit copper into the recessed structures. Although these additives are known to have levelling effects in electrolytic plating baths they do not have any substantial effect on the plating rate or stability of electroless plating baths (see Application Example 6). Also, such additives are only to improve the wettability of surface in accordance with the teachings of US 2005/0161338 in case of cobalt plating.

JP 2007-254793 teaches nitrogen-containing polymers made of monomers such as dicyandiamide, lysine and mono- or diallylamines to be suitable stabilising agents for electroless nickel plating baths. Also, US 2014/0087560 A1 discloses nitrogen-containing polymers such as polyvinylamines to be used in electroless deposition of nickel and cobalt. The latter plating baths are particularly suitable for forming barrier layers in recessed structures prior to electrolytic copper deposition thereon as the plating rates are reduced. The use of polymers containing high amounts of amines is not desirable because such polymers are highly hazardous to water and may result in discolouration of deposited metal layers.

OBJECTIVE OF THE PRESENT INVENTION

It is an objective of the present invention to provide an electroless plating bath for deposition of copper, nickel, cobalt or alloys of the aforementioned with reduced plating rate.

It is a further objective of the present invention to provide electroless metal plating baths for deposition of copper, nickel, cobalt and alloys of the aforementioned which allow for smooth and glossy metal or metal alloy deposits to be formed.

It is yet another objective of the present invention to provide stable electroless plating bath which are stable against metal salt precipitation for a prolonged period of time.

SUMMARY OF THE INVENTION

These objectives are solved by an electroless plating bath for deposition of copper, nickel, cobalt or alloys thereof comprising at least one source for metal ions and at least one reducing agent characterized in that the electroless plating bath further comprises a plating rate modifier according to formula (I)

(I)

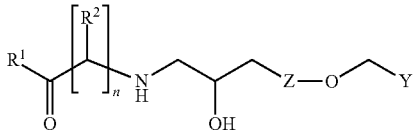

wherein monovalent residues $R^1$ to $R^2$, end group Y and divalent spacer group Z and index n are selected from the following groups $R^1$ is selected from the group consisting of —O—$R^3$ and —NH—$R^4$ wherein $R^3$ is selected from hydrogen, lithium, sodium, potassium, rubidium, caesium, ammonium, alkyl, aryl, and $R^4$ is selected from hydrogen, alkyl and aryl;

$R^2$ is selected from the group consisting of hydrogen, alkyl, alkylaryl, and aryl;

Y is selected from the group consisting of

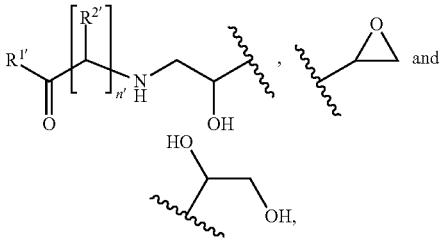

wherein the monovalent residue $R^{1'}$ is selected from the group consisting of —O—$R^{3'}$ and —NH—$R^{4'}$ wherein $R^{3'}$ is selected from hydrogen, lithium, sodium, potassium, rubidium, caesium, ammonium, alkyl, aryl, and $R^{4'}$ is selected from hydrogen, alkyl and aryl and monovalent residue $R^{2'}$ is selected from the group consisting of hydrogen, alkyl, alkylaryl, and aryl and n' is an integer ranging from 1 to 2;

Z is

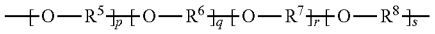

wherein $R^5$ to $R^8$ are unbranched saturated alkylene residues wherein individual hydrogen bonded to said unbranched saturated alkylene residues in each case are optionally substituted by a functional group selected from alkyl, aryl and hydroxyl (—OH); preferably, the substituents are selected from $C_1$- to $C_4$-alkyl, phenyl and hydroxyl, and more preferably the substituents are selected from methyl, ethyl, hydroxyl; wherein p is an integer ranging from 1 to 100, q is an integer ranging from 0 to 99, r is an integer ranging from 0 to 99, s is an integer ranging from 0 to 99 with the proviso that the sum of (p+q+r+s) ranges from 1 to 100, preferably 1 to 50; and n is an integer ranging from 1 to 2.

These objectives are also solved by the inventive process for the deposition of a metal or metal alloy, comprising the steps of (i) providing a substrate;

(ii) contacting said substrate with an electroless plating bath comprising at least one source of metal ions, at least one reducing agent, and at least one plating rate modifier according to formula (I); and thereby depositing a metal or metal alloy layer on at least a portion of said substrate.

DETAILED DESCRIPTION OF THE INVENTION

Above-captioned objectives are solved by using an inventive plating rate modifier according to formula (I) in an electroless plating bath suitable to deposit copper, nickel, cobalt and alloys of any of the aforementioned.

The inventive plating rate modifier according to formulae (I) and (II) will be abbreviated as "plating rate modifier" in the claims and description. The terms plating and deposition are used synonymously herein.

Z may exemplarily be a divalent residue derived from a homopolymer formed of ethylene oxide or polypropylene oxide, a copolymer of ethylene oxide and butylene oxide, or a terpolymer of ethylene oxide, propylene oxide and styrene oxide or it may be 2-hydroxypropane-1,3-diyl(-$CH_2$—CH(OH)—$CH_2$—), a dimer or oligomer derived from any of the aforementioned.

In a preferred embodiment of the present invention Y in the plating rate modifier according to formula (I) is

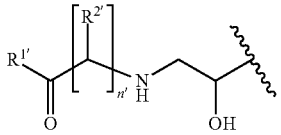

and the plating rate modifier results in the plating rate modifier according to formula (II)

(II)

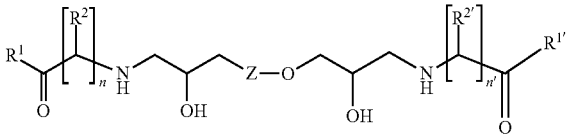

wherein monovalent residues $R^1$, $R^{1'}$, $R^2$, $R^{2'}$ and divalent spacer group Z (including residues $R^5$ to $R^8$ and indices p, q, r, s contained therein) and the indices n and n' are selected from the same groups as described for formula (I). Exemplarily, $R^1$ in formulae (I) and (II) is selected from the group consisting of —O—$R^3$ and —NH—$R^4$ wherein $R^3$ is selected from hydrogen, lithium, sodium, potassium, rubidium, caesium, ammonium, alkyl, aryl, and $R^4$ is selected from hydrogen, alkyl and aryl.

In a more preferred embodiment of the present invention the residues $R^5$ to $R^8$ in the plating rate modifier according to formulae (I) and (II) are unbranched saturated $C_1$- to $C_6$-alkylen residues, even more preferably unbranched saturated $C_2$- to $C_4$-alkylen residues, wherein individual hydrogen bonded to said unbranched saturated alkylene residues in each case are optionally substituted by a functional group selected from alkyl, aryl and hydroxyl (—OH); preferably, the substituents are selected from $C_1$- to $C_4$-alkyl, phenyl and hydroxyl, and more preferably the substituents are selected from methyl, ethyl and hydroxyl.

In an even more preferred embodiment of the present invention residues $R^5$ to $R^8$ in the plating rate modifier according to formulae (I) and (II) are selected from the group consisting of ethane-1,2-diyl(-$CH_2$—$CH_2$—), propane-1,2-diyl(-CH($CH_3$)—$CH_2$—), butane-1,2-diyl(-CH($CH_2$—$CH_3$)—$CH_2$—) and 2-hydroxypropane-1,3-diyl(-$CH_2$—CH(OH)—$CH_2$—).

It is particularly preferred that monovalent residues $R^1$ and $R^{1'}$ are the same in the plating rate modifier according to formula (II), $R^2$ and $R^{2'}$ are the same in the plating rate modifier according to formula (II) and n and n' are the same in the plating rate modifier according to formula (II) because this facilitates the synthesis of the plate rate modifier.

In so far as the term "alkyl" is used in this description and in the claims, it refers to a hydrocarbon radical with the general chemical formula $C_mH_{2m+1}$, m being an integer from 1 to about 50. Alkyl residues according to the present invention can be linear and/or branched and they can be saturated and/or unsaturated. If the alkyl residues are unsaturated the corresponding general chemical formula has to be adjusted accordingly. Preferably, m ranges from 1 to 12, more preferably from 1 to 8. $C_1$-$C_8$-alkyl for example includes, among others, methyl, ethyl, n-propyl, iso-propyl, n-butyl, iso-butyl, tert-butyl, n-pentyl, iso-pentyl, sec-pentyl, tert-pentyl, neo-pentyl, hexyl, heptyl and octyl. Alkyl can be substituted by replacing a hydrogen in each case by a functional group, for example amino, hydroxy, thiol, halides such as fluorine, chlorine, bromine, iodine, carbonyl, carboxyl, carboxylic acid esters and so forth.

In so far as the term "alkylene" is used in this description and in the claims, it refers to a hydrocarbon diradical with the general chemical formula $C_kH_{2k}$, k being an integer from 1 to about 50. Unless stated otherwise, alkylene residues according to the present invention can be linear (unbranched) and/or branched and they can be saturated and/or unsaturated. If the alkylene residues are unsaturated the corresponding general chemical formula has to be adjusted accordingly. $C_1$-$C_4$-alkylen for example includes, among others, methane-1,1-diyl, ethane-1,2-diyl, ethane-1,1-diyl, propane-1,3-diyl, propane-1,2-diyl, propane-1,1-diyl, butane-1,4-diyl, butane-1,3-diyl, butane-1,2-diyl, butane-1,1-diyl, butane-2,2-diyl, butane-2,3-diyl. Alkylene can be substituted by replacing a hydrogen in each case by a functional group, for example amino, hydroxy, halides such as fluorine, chlorine, bromine, iodine, carbonyl, carboxyl, carboxylic acid esters and so forth.

In so far as the term "alkylaryl" is used in this description and in the claims, it refers to combinations of alkyl and aryl radicals such as benzyl residues. The bonding sites in end group Y are emphasised by a wavy line ("∿").

The plating rate modifiers can be prepared by known means in the art. Exemplarily, but not limiting, they can be obtained by a reaction of a diglycidylether and a suitable amino acid or a respective derivative thereof. Suitable amino acids are without limitation histidine, isoleucine, leucine, lysine, methionine, phenylalanine, threonine, tryptophan, valine, alanine, arginine, asparagine, aspartic acid, cysteine, glutamic acid, glutamine, ornithine, serine, tyrosine, and the respective β-derivatives thereof. Suitable derivatives of amino acids may be amino acid esters or amino acid amides. The conversion of the starting materials may be carried out in one or more polar and/or protic solvents, water being most preferred. It is also useful to add one or more bases to the starting materials since better yields are then obtainable. Such bases can be hydroxide donors such as alkali hydroxides, earth alkali hydroxides, suitable carbonates, bicarbonates, alkoxylates or amines. The starting materials are reacted at a temperature of 20 to 100° C., preferably at a temperature of 30 to 90° C., more preferred at a temperature of 50 to 70° C. for a given time. Preferably, they are kept at said temperature until the starting materials are completely consumed or until the reaction does not proceed any further. The duration of the synthesis depends on the individual starting materials, the temperature, and other parameters such as stirring speed, concentrations and the like. The plating rate modifiers may be used as received from above-captioned method, they may be diluted with one or more solvents or concentrated by means of solvent evaporation or they may purified by means known in the art.

The electroless plating bath according to the invention is an aqueous solution. The term "aqueous solution" means that the prevailing liquid medium, which is the solvent in the solution, is water. Further liquids, that are miscible with water, as for example alcohols and other polar organic liquids, that are miscible with water, may be added.

The electroless plating bath according to the invention may be prepared by dissolving all components in aqueous liquid medium, preferably in water.

The plating rate modifier is contained in the electroless plating bath in a concentration of 0.1 to 1500 μmol/l, preferably 1 to 1000 μmol/l, more preferably 5 to 500 μmol/l, most preferred 10 to 200 μmol/l. The electroless plating bath may optionally further comprise a stabilising agent.

The at least one source of metal ions present in the electroless plating bath according to the invention is selected from water soluble copper, nickel and cobalt salts and water soluble copper, nickel and cobalt compounds.

In one embodiment of the present invention the at least one source of metal ions comprised in the electroless plating bath is a source of copper ions. Such an electroless plating bath will henceforth be called "inventive electroless copper plating bath".

The at least one source for copper ions may be any water soluble copper salt or other water soluble copper compound. Preferably, the source of copper ions is selected from the group comprising copper sulphate, copper chloride, copper nitrate, copper acetate, copper methane sulphonate ($(CH_3O_3S)_2Cu$) or hydrates thereof and mixtures of the aforementioned.

The concentration of copper ions in the inventive electroless copper plating bath preferably ranges from 0.1 to 5 g/l, corresponding to 0.0016 to 0.079 mol/l.

The inventive electroless copper plating bath comprises at least one reducing agent. Suitable reducing agents can preferably be selected from the group consisting of formaldehyde, paraformaldehyde, glyoxylic acid, sources of glyoxylic acid, aminoboranes such as dimethylaminoborane, alkali borohydrides such as $NaBH_4$, $KBH_4$, hydrazine, polysaccharides, sugars such as glucose, hypophosphoric acid, glycolic acid, formic acid, salts of aforementioned acids and mixtures thereof. If the inventive electroless copper plating bath contains more than one reducing agent it is preferable that the further reducing agent is an agent that acts as reducing agent but cannot be used as the sole reducing agent (cf. U.S. Pat. No. 7,220,296, col. 4, I. 20-43 and 54-62). Such further reducing agent is in this sense also called an "enhancer".

The term "source of glyoxylic acid" encompasses glyoxylic acid and all compounds that can be converted to glyoxylic acid in aqueous solution. In aqueous solution the aldehyde containing acid is in equilibrium with its hydrate. A suitable source of glyoxylic acid is dihaloacetic acid, such as dichloroacetic acid, which will hydrolyse in an aqueous medium to the hydrate of glyoxylic acid. An alternative source of glyoxylic acid is the bisulphite adduct as is a hydrolysable ester or other acid derivative. The bisulphite adduct may be added to the com-position or formed in situ. The bisulphite adduct may be made from glyoxylate and either bisulphite, sulphite or metabisulphite.

The concentration of the reducing agent in the inventive electroless copper plating bath agent preferably ranges from 2 to 20 g/l. In one embodiment of the present invention, the inventive electroless copper plating bath comprises one or more reducing agents in the total concentrations thereof (i.e. in this connection the total amount of reducing agents) ranging from 0.027 to 0.270 mol/l, preferably 0.054 to 0.2 mol/l.

The inventive electroless copper plating bath using reducing agents mentioned above preferably employs a relatively high pH, usually between 11 and 14, or 12.5 and 14, preferably between 12.5 and 13.5, or 12.8 and 13.3. The pH is adjusted generally by pH adjustors such as potassium hydroxide (KOH), sodium hydroxide (NaOH), lithium hydroxide (LiOH), caesium hydroxide (CsOH), rubidium hydroxide (RbOH), ammonium hydroxide ($NH_4OH$), tetramethylammonium hydroxide (TMAH) or tetrabutylammonium hydroxide (TBAH) and mixtures thereof. Caesium hydroxide (CsOH), rubidium hydroxide (RbOH) and mixtures thereof are preferred to adjust the pH. Thus, the inventive electroless copper plating bath may contain a source of hydroxide ions, as for example and without limitation one or more of the compounds listed above.

The inventive electroless copper plating bath comprises at least one complexing agent (sometimes referred to as chelating agent in the art). Suitable complexing agents are for example, without limitation, alkanol amines such as triethanol amine, hydroxycarboxylic acids such as glycolic acid or tartaric acid, polyamino monosuccinic acid, polyamino disuccinic acids as disclosed in WO 2014/154702 such as ethylenediamine-N,N'-disuccinic acid, ethylenediamine tetraacetic acid (EDTA), N'-(2-hydroxyethyl)-ethylene diamine-N,N,N'-triacetic acid (HEDTA), cyclohexanediamine tetraacetic acid, diethylenetriamine pentaacetic acid, and tetrakis-(2-hydroxypropyl)-ethylenediamine or salts and mixtures of any of the aforementioned.

The at least one complexing agent is more preferably selected from the group comprising polyamino monosuccinic acid, polyamino disuccinic acid, tartrate, N,N,N',N'-tetrakis-(2-hydroxypropyl)-ethylenediamine, N'-(2-hydroxyethyl)-ethylenediamine-N,N,N'-triacetic acid, ethylenediamine tetraacetic acid (EDTA), salts and mixtures thereof.

The concentration of the at least one complexing agent in inventive electroless copper plating preferably ranges from 5 to 50 g/l. In a further embodiment, the molar ratio of complexing agent, which means in this connection the total amount of complexing agent(s) to copper ions is 2:1 to 5:1, more preferably 2.5:1 to 5:1. This embodiment is particularly advantageous if the inventive electroless copper plating bath is agitated during deposition, preferably agitated with a gas such as nitrogen, and when a further reducing agent (also called "enhancer") is used in addition to a first reducing agent such as glyoxylic acid, wherein the further reducing agent is preferably selected from glycolic acid, hypophosphoric acid, or formic acid, most preferably glycolic acid.

An optional stabilising agent may further extend the life time of the inventive electroless cobalt plating bath and may help to prevent undesired decomposition of the plating bath. Stabilising agents are also called stabilisers in the art. Both terms are used interchangeably herein. Reduction of copper (II) should only occur on the desired substrate surface and not unspecific in the whole bath. A stabilising function can for example be accomplished by substances acting as catalyst poison (for example sulphur or other chalcogenide containing compounds) or by compounds forming copper (I)-complexes, thus inhibiting the formation of copper(I) oxide. The plating rate modifier also provides such a stabilising effect on an electroless copper plating bath (see Application Example 7).

Suitable stabilising agents which may optionally be contained in the inventive electroless copper plating bath are, without limitation, dipyridyls(2,2'-dipyridyl, 4,4'-dipyridyl), phenanthroline, mercaptobenzothiazole, thiourea or its derivatives like diethylthiourea, cyanides like NaCN, KCN, ferrocyanides such as $K_4[Fe(CN)_6]$, thiocyanates, iodides, ethanolamines, mercaptobenzotriazole, $Na_2S_2O_3$, polymers like polyacrylamides, polyacrylates, polyethylene glycols, or polypropylene glycols and their copolymers, wherein 2,2'-dipyridyl, diethylthiourea, $K_4[Fe(CN)_6]$, NaCN and mercaptobenzothiazole are particularly suitable. In addition, molecular oxygen is often used as a stabilising agent additive by passing a steady stream of air through the copper electrolyte (ASM Handbook, Vol. 5: Surface Engineering, pp. 311-312). In one embodiment, the stabilising agent is chosen, mainly for environmental and occupational health reasons, from a stabilising agent that is free of cyanides. Thus, the solution of the present invention is preferably free of cyanides. In this connection, 2,2'-dipyridyl is a preferred stabilising agent. Dipyridyl is preferably added in an amount of 1-10 mg/l.

Accelerators are sometimes referred to as exaltants in the art (G. O. Mallory, J. B. Hajdu, Electroless Plating: Fundamentals And Applications, Reprint Edition, American Electroplaters and Surface Finishers Society, pp. 289-295). These compounds may be added to increase the plating rate without decreasing the plating bath stability. Suitable exaltants are, without limitation, propionitrile, and O-phenanthroline. It is possible within the means of the present invention to combine exaltants and the plating rate modifier to adjust the plating rate of the inventive electroless copper plating bath. However, it is possible to adjust the plating rate of any electroless plating baths such as those suitable to deposit copper, nickel, cobalt or alloys thereof by modifying the concentration of the plating rate modifier therein. It is preferred not to add any accelerators to the inventive electroless copper plating bath.

The inventive electroless copper plating bath may optionally comprise further components, as for example surfactants, wetting agents, additives such as grain refining additives and pH buffers. Such further components are for example described in following documents, which are incorporated by reference in their entirety: U.S. Pat. No. 4,617,205 (particularly disclosure in col. 6, I. 17-col. 7, I. 25), U.S. Pat. No. 7,220,296 (particularly col. 4, I. 63-col. 6, I. 26), US 2008/0223253 (cf. particularly paragraphs 0033 and 0038).

In one embodiment of the present invention the inventive electroless copper plating bath further to the above mentioned components comprises a second source for metal ions other than copper ions. The second source of metal ions are for example water-soluble salts and water-soluble compounds of metals such as nickel and cobalt. Suitable nickel ion sources and cobalt ion sources can be selected from those described below. In case a second source of metal ions is comprised in the inventive electroless copper plating bath a secondary copper/second metal alloy such copper/nickel alloy is obtained.

The amount of second metal ions in the inventive electroless copper plating bath may be sufficient to reach a concentration of 0.1 to 2 wt.-% of second metal in the deposited copper alloy.

A preferred electroless copper plating bath for the deposition of copper and copper alloys comprises a source for copper ions and optionally a source for second metal ions, a source of formaldehyde or glyoxylic acid as reducing agent, and at least one polyamino disuccinic acid, or at least one polyamino monosuccinic acid, or a mixture of at least one polyamino disuccinic acid and at least one polyamino monosuccinic acid, or tartrate, a mixture of N,N,N',N'-tetrakis-(2-hydroxypropyl)-ethylenediamine and N'-(2-hydroxyethyl)-ethylenediamine-N,N,N'-triacetic acid, or a mixture of N,N,N',N'-tetrakis-(2-hydroxypropyl)-ethylenediamine and ethylenediamine-tetra-acetic acid and salts thereof as complexing agent and at least one plating rate modifier according to formula (I). Said complexing agents are particularly preferred in combination with glyoxylic acid as reducing agent.

In one embodiment of the present invention the at least one source of metal ions comprised in the inventive electroless plating bath is a source of nickel ions. Such an electroless plating bath will henceforth be called "inventive electroless nickel plating bath".

The at least one source of nickel ions may be any water soluble salts or other water soluble nickel compound. Preferred sources of nickel ions are selected from the group comprising nickel chloride, nickel sulphate, nickel acetate, nickel methanesulphonate and nickel carbonate.

The concentration of nickel ions in the inventive electroless nickel plating bath preferably ranges from 0.1 to 60 g/l (0.0017 to 1.022 mol/l), more preferably from 2 to 50 g/l (0.034 to 0.852 mol/l), even more preferably from 4 to 10 g/l (0.068 to 0.170 mol/l).

The inventive electroless nickel plating bath further contains a reducing agent which is selected from hypophosphite compounds such as sodium hypophosphite, potassium hypophosphite and ammonium hypophosphite, boron based reducing agents such as aminoboranes like dimethylaminoborane (DMAB), alkali borohydrides like $NaBH_4$, $KBH_4$, formaldehyde, hydrazine and mixtures thereof. The concentration of reducing agent (which means in this connection the total amount of reducing agents) in the inventive electroless nickel plating bath typically ranges from 0.05 to 1.5 mol/l. Hypophosphite compounds as reducing agents are preferred.

The pH value of the inventive electroless nickel plating bath preferably ranges from 3.5 to 6.5, more preferably from 4 to 6. Since the plating solution has a tendency to become more acidic during its operation due to the formation of $H_3O^+$ ions, the pH may be periodically or continuously adjusted by adding bath-soluble and bath-compatible alkaline substances such as sodium, potassium or ammonium hydroxides, carbonates and bicarbonates. The stability of the operating pH of the plating solutions can be improved by the addition of various buffer compounds such as acetic acid, propionic acid, boric acid, or the like, in amounts of up to 30 g/l, more preferably from 2 to 10 g/l.

In one embodiment of the present invention, carboxylic acids, polyamines and sulphonic acids or mixtures thereof are selected as complexing agents. Useful carboxylic acids include mono-, di-, tri- and tetra-carboxylic acids. The carboxylic acids may be substituted with various substituent moieties such as hydroxy or amino groups and the acids may be introduced into the inventive electroless nickel plating baths as their sodium, potassium or ammonium salts. Some complexing agents such as acetic acid, for example, may also act as a buffering agent, and the appropriate concentration of such additive components can be optimised for any plating solution in consideration of their dual functionality.

Examples of such carboxylic acids which are useful as the complexing agents include: iminosuccinic acid, iminodisuccinic acid, derivatives thereof and salts thereof as disclosed in WO 2013/113810, monocarboxylic acids such as acetic acid, hydroxyacetic acid, aminoacetic acid, 2-amino propanoic acid, 2-hydroxy propanoic acid, lactic acid; dicarboxylic acids such as succinic acid, amino succinic acid, hydroxy succinic acid, propanedioic acid, hydroxybutanedioic acid, tartaric acid, malic acid; tricarboxylic acids such as 2-hydroxy-1,2,3-propane tricarboxylic acid; and tetracarboxylic acids such as ethylene-diamine-tetra-acetic acid (EDTA).

The most preferred complexing agents are selected from the group consisting of monocarboxylic acids and dicarboxylic acids. In one embodiment, mixtures of two or more of the above complexing agents are utilized.

The concentration of the complexing agent present in the inventive electroless nickel plating bath or, in case more than one complexing agent is used, the concentration of all complexing agents together preferably ranges from 0.01 to 2.5 mol/l, more preferably from 0.05 to 1.0 mol/l.

The inventive electroless nickel plating bath optionally contains at least one stabilising agent. Such stabilising agent is required in order to provide a sufficient bath lifetime, a reasonable plating rate and to control the phosphorous content in the as deposited nickel phosphorous alloy. Since the plating rate modifier acts as stabilising agent, a further stabilising agent is not necessary. Suitable optional stabilising agents are, without limitation, heavy metal ions such cadmium, thallium, bismuth, lead and antimony ions, iodine containing compounds such as iodide and iodate, sulphur containing compounds such as thiocyanate, thiourea and mercaptoalkanesulphonic acids like 3-mercaptopropanesulphonic acid or the respective disulphides derived therefrom as disclosed in WO 2013/013941 and unsaturated organic acids such as maleic acid and itaconic acid or suitably substituted alkynes as those taught by EP 2 671 969 A1. It is also within the scope of the present invention to use combinations of stabilising agents such as bismuth ions and mercaptobenzoic acids, mercaptocarboxylic acids and/or mercaptosulphonic acids as taught by WO 2013/113810.

The concentration of the at least one optional stabilising agent in the inventive electroless nickel plating bath ranges from 0.1 to 100 mg/l, preferably from 0.5 to 30 mg/l.

The inventive electroless nickel plating bath may comprise—but does not necessarily comprise—further additives such as wetting agents, surfactants, accelerators, brighteners, grain refining additives etc. These components are known in the art. As stated above for the inventive electroless copper plating bath the plating rate of the inventive electroless nickel plating bath may be adjusted by adding accelerators; however, it is possible to adjust the plating rate solely by using the plating rate modifier. It is preferred not to add any accelerators to the inventive electroless nickel plating bath.

In case a hypophosphite compound is used as the reducing agent for nickel, nickel and phosphorous containing alloy deposits are obtained. The amount of phosphorous in said alloy deposit depends inter alia on the concentration of hypophosphite and nickel ions in the inventive electroless nickel plating bath and the optional stabilising agent. Preferably, the amount of phosphorous in said alloy deposit ranges from 5 to 15 wt.-% with the balance being nickel, more preferred it ranges from 10.5 to 15 wt.-% with the balance being nickel as these so-called high-phosphorous coatings are paramagnetic.

In case a boron-based reducing agent is used as the reducing agent for nickel, nickel and boron containing alloy deposits are obtained. The amount of boron in said alloy deposit depends inter alia on the concentration of boron-based reducing agent and nickel ions in the inventive electroless nickel plating bath and the optional stabilising agent. Preferably, the amount of boron in said alloy deposit ranges from 1 to 20 wt.-% with the balance being nickel.

In case one or more of hydrazine or formaldehyde are used as the reducing agents for nickel, pure nickel deposits are obtained.

The inventive electroless nickel plating bath may optionally comprise a second source of metal ions such as molybdenum or tungsten ions. These second metal ions may preferably be added as water soluble salts or compounds such as $MoO_2(OH)_2$, $WO_2(OH)_2$, $Na_2MoO_4$ and $Na_2WO_4$ and their respective hydrates.

The amount of second metal ions added to the inventive electroless nickel plating bath preferably ranges from 0.01 to 0.2 mol/l, more preferably from 0.05 to 0.15 mol/l. The amount of second metal ions in the inventive electroless nickel plating bath may be sufficient to reach a concentration of 4 to 20 wt.-% of second metal in the deposited nickel alloy.

In a preferred embodiment of the present invention the inventive electroless nickel plating bath comprises a source for nickel ions such as nickel sulphate, as source for hypophosphite ions such as sodium hypophosphite, at least two dicarboxylic acids and at least one monocarboxylic acid as complexing agents, and at least one plating rate modifier.

In one embodiment of the present invention the at least one source of metal ions comprised in the electroless plating bath is a source of cobalt ions. Such an electroless plating bath will henceforth be called "inventive electroless cobalt plating bath".

The source for cobalt ions may be any water soluble cobalt salt or other water-soluble cobalt compound. Preferably, the source of cobalt ions is selected from the group comprising cobalt chloride, cobalt sulphate and their respective hydrates.

The concentration of cobalt ions in the inventive electroless cobalt plating bath ranges from 0.6 to 35.4 g/l (0.01 to 0.6 mol/l), more preferably from 3.0 to 17.7 g/l (0.05 to 0.3 mol/l).

A complexing agent or a mixture of complexing agents is included in the inventive electroless cobalt plating bath. In one embodiment, carboxylic acids, hydroxyl carboxylic acids, aminocarboxylic acids and salts of the aforementioned or mixtures thereof may be employed as complexing or chelating agents. Useful carboxylic acids include the mono-, di-, tri- and tetra-carboxylic acids. The carboxylic acids may be substituted with various substituent moieties such as hydroxy or amino groups and the acids may be introduced into the plating bath as their sodium, potassium or ammonium salts. Some complexing agents such as acetic acid, for example, may also act as a pH buffering agent, and the appropriate concentration of such additive components can be optimised for any plating bath in consideration of their dual functionality.

Examples of such carboxylic acids which are useful as the complexing or chelating agents in the plating bath of the present invention include: monocarboxylic acids such as acetic acid, hydroxyacetic acid (glycolic acid), aminoacetic acid (glycine), 2-amino propanoic acid, (alanine); 2-hydroxy propanoic acid (lactic acid); dicarboxylic acids such as succinic acid, amino succinic acid (aspartic acid), hydroxy succinic acid (malic acid), propanedioic acid (malonic acid), tartaric acid; tricarboxylic acids such as 2-hydroxy-1,2,3-propane tricarboxylic acid (citric acid); and tetracarboxylic acids such as ethylene diamine tetra acetic acid (EDTA). In one embodiment, mixtures of two or more of the above complexing agents are utilised in the plating bath according to the present invention.

The concentration of the complexing agent present in the inventive electroless cobalt plating bath or, in case more than one complexing agent is used, the concentration of all complexing agents together preferably ranges from 0.01 to 2.0 mol/l, more preferably from 0.05 to 1.5 mol/l.

The reducing agent present in the inventive electroless cobalt plating bath is selected from hypophosphite compounds, boron-based reducing agents, formaldehyde, hydrazine and mixtures thereof.

In one embodiment of the present invention, the inventive electroless cobalt plating bath contains a hypophosphite compound which provides hypophosphite ions derived from hypophosphorous acid or a bath soluble salt thereof such as sodium hypophosphite, potassium hypophosphite and ammonium hypophosphite as reducing agent.

The concentration of hypophosphite ions in the inventive electroless cobalt plating bath preferably ranges from 0.01 to 0.5 mol/l, more preferably from 0.05 to 0.35 mol/l.

In another embodiment of the present invention the plating bath contains a borane-based reducing agent. Suitable borane-based reducing agents are for example dimethylamine borane (DMAB) and water-soluble borohydride compounds such as $NaBH_4$ or $KBH_4$.

The concentration of the borane-based reducing agent preferably ranges from 0.01 to 0.5 mol/l, more preferably from 0.05 to 0.35 mol/l.

In still another embodiment of the present invention, a mixture of hypophosphite ions and a borane-based reducing agent is employed in the inventive electroless cobalt plating bath.

In case a hypophosphite compound is used as the reducing agent, a cobalt and phosphorous containing alloy deposit is obtained. A borane-based compound as reducing agent results in a cobalt and boron containing alloy deposit and a mixture of hypophosphite and borane-based compounds as the reducing agents leads to a cobalt, phosphorous and boron containing alloy deposit.

The inventive electroless cobalt plating bath optionally contains a stabilising agent. Since the plating rate modifier acts as stabilising agent, a further stabilising agent is not necessary. Suitable optional stabilising agents may be, without limitation, alkynesulphonic acids as disclosed in WO 2013/135396, imidazole, thiazole, triazole, disulphides, acetylenic compounds such as propargyl alcohol.

The optional stabilising agent may further extend the life time of the inventive electroless cobalt plating bath and may help to prevent undesired decomposition of the plating bath.

The concentration of the stabilising agent preferably ranges from 0.05 to 5.0 mmol/l, more preferably from 0.1 to 2.0 mmol/l.

The inventive electroless cobalt plating bath according to the present invention preferably has a pH value of 7.5 to 12, more preferably of 8 to 11. It is possible to use pH adjustors such as those described above.

The inventive electroless cobalt plating bath may comprise—but does not necessarily comprise—further additives such as pH buffers, wetting agents, surfactants, accelerators, brighteners, grain refining additives, oxygen scavengers etc. such compounds are known in the art. Some suitable compounds are disclosed in US 2007/0167857 (paragraph 20 to 23) and US 2005/0161338 (paragraph 46 to 55). As stated above for the inventive electroless copper plating bath the plating rate of the inventive electroless cobalt plating bath may be adjusted by adding accelerators; however, it is possible to adjust the plating rate solely by using the plating rate modifier. It is preferred not to add any accelerators to the inventive electroless cobalt plating bath.

The inventive electroless cobalt plating bath may optionally comprise a second source of metal ions such as molybdenum or tungsten ions, preferably tungsten ions. These second metal ions may preferably be added as water soluble salts or compounds such as $MoO_2(OH)_2$, $WO_2(OH)_2$, $Na_2MoO_4$ and $Na_2WO_4$ and their respective hydrates.

The amount of second metal ions added to the inventive electroless cobalt plating bath preferably ranges from 0.001 to 0.1 mol/l, more preferably from 0.005 to 0.06 mol/l. The amount of second metal ions in the inventive electroless cobalt plating bath may be sufficient to reach a concentration of 4 to 50 wt.-% of second metal in the deposited cobalt alloy.

In a preferred embodiment of the present invention the inventive electroless cobalt plating bath comprises a source for cobalt ions, a source for tungsten ions, a source for hypophosphite ions such as sodium hypophosphite and one or more complexing agents such as citric acid, lactic acid, malic acid, malonic acid or salts thereof.

The inventive process for the deposition of a metal or metal alloy, comprises the steps of (i) providing a substrate;

(ii) contacting said substrate with an electroless plating bath comprising at least one source of metal ions, at least one reducing agent, and at least one plating rate modifier; and thereby depositing a metal or metal alloy layer on at least a portion of said substrate.

The inventive process is particularly suitable for the electroless deposition of copper, nickel, cobalt and alloys thereof.

Substrates to be used in the context of the present invention may be selected from the group comprising nonconductive substrates and conductive substrates. Nonconductive substrates may be plastics, glass, silicon such as semiconductor wafers and dielectric substrates such as those made of epoxy resins and epoxy glass composites. Substrates which are used in the Electronics industry such as printed circuit boards, chip carriers, IC substrates or circuit carriers and interconnect devices and display devices may also preferably be used. Conductive substrates are metallic substrates such as aluminium sheets used for manufacturing of rigid memory disks.

The electroless plating bath according to the invention and the process according to the invention are preferably used for the coating of printed circuit boards, chip carriers, IC substrates and semiconductor wafers (semiconductor substrates) or circuit carriers and interconnect devices. The electroless plating bath is used in particular in printed circuit boards, IC substrates and chip carriers, but also in semiconductor wafers, to plate surfaces, trenches, blind micro vias, through hole vias (through holes) and similar structures with metals such as copper, nickel, cobalt or alloys thereof.

Particularly, the electroless plating bath of the invention or the process of the invention can be used for deposition of metal or metal alloys on surfaces, in trenches, blind micro vias, through hole vias, and comparable structures in printed circuit boards, chip carriers, IC substrates and semiconductor wafers (semiconductor substrates), circuit carriers and interconnect devices. The term "through hole vias" or "through holes", as used in the present invention, encompasses all kinds of through hole vias and includes so-called "through silicon vias" in silicon wafers. Trenches, blind micro vias, through hole vias, and comparable structures are summarily denominated as recessed structures herein.

Another application that is envisaged for the electroless plating baths is metallization of display devices. In this regard, one or more metals or metal alloys, preferably copper, are deposited particularly on glass substrates, particularly flat glass surfaces or plastic substrates, particularly polyimide (PI) or polyethylene terephthalate (PET) foils. The inventive process on said substrates is beneficial in comparison to metal sputtering processes that have been used so far. Benefits that can be reached with the inventive process in comparison to sputtering techniques are, inter alia, reduced internal stress and reduced bending of said substrates, reduced equipment maintenance, effective use of metal, reduced material waste.

The process according to the invention may comprise further steps (i.a) pretreating the substrate.

Preferably, step (i.a) is carried out between steps (i) and (ii). Suitable pre-treatment steps are known in the art and exemplary, but not limiting, described hereinafter. It is known to those skilled in the art that substrates sometimes are contaminated with residues from processing, human contact or the environment such as for example grease, fat or wax residues. Residues which may be detrimental to the plating are for example oxidation products, grease or wax. Therefore, commonly one or more pre-treatment steps are advantageous in those cases in order to obtain optimal plating results. These pre-treatment steps are known in the art and sometimes referred to as etching, reducing or cleaning. These steps include among others removal of said residues with organic solvents, acidic or alkaline aqueous solutions or solutions comprising surfactants, reducing agents and/or oxidation agents. It is also possible within the scope of the present invention to combine the aforementioned steps in order to obtain cleaned substrates. It is also possible to include further rinsing steps before, between or after these pre-treatment steps. Sometimes, an etching step is included in the pre-treatment of the substrate to increase its surface area. This is commonly accomplished by treating the substrate with an aqueous solution comprising strong acids like sulphuric acid and/or oxidation agents like hydrogen peroxide.

Plastic substrates often—but not always—require to be treated with an oxidative treatment prior to activation. These methods are well-known in the art. Examples for such treatment include etching with acidic or alkaline solutions comprising further oxidations agents such as chromic acid, sulphuric acid, hydrogen peroxide, permanganate, periodate, bismuthate, halogen oxo compounds such chlorite, chlorous, chlorate, perchlorate, the respective salts thereof or the respective bromine and iodine derivatives. Examples for such etching solutions are disclosed for example in EP 2 009 142 B1, EP 1 001 052 A2 and U.S. Pat. No. 4,629,636. The latter also discloses a method of pre-treating a plastic surface including an activation step (Examples I and II therein). Plastic substrates in the context of the present invention are selected from a group consisting of acrylonitrile-butadiene-styrene copolymer (ABS copolymer), polyamide (PA), polycarbonate (PC), polyimide (PI), polyethylene terephthalate (PET) and mixtures of the aforementioned.

Nonconductive substrates that are to be contacted with an inventive electroless plating bath, particularly non-metallic surfaces, may further be pre-treated by means within the skill in the art (as for example described in U.S. Pat. No. 4,617,205, col 8) to make them (more) receptive or autocatalytic for the deposition of metals or metal alloys. This pre-treatment step is referred to as activation. All or selected portions of a surface may be activated. This activation of glass substrates, silicon substrates and plastic substrates by a metal such as copper, silver, gold, palladium, platinum, rhodium, cobalt, ruthenium, iridium, conductive polymers or electrically conductive carbon black, preferably by a metal, more preferred by one of palladium, ruthenium and cobalt, is carried out between steps (i) and (ii).

Within the activation, it is possible to sensitise substrates prior to the deposition of the metal or metal alloy thereon. This may be achieved by the adsorption of a catalysing metal onto the surface of the substrate.

The inventive electroless copper plating bath is preferably held at a temperature in the range of 20 to 60° C., more preferably 30 to 55° C. and most preferably 33 to 40° C. during step (ii).

The inventive electroless nickel plating bath is preferably held at a temperature in the range of 25 to 100° C., more preferably 35 to 95° C. and most preferably 70 to 90° C. during step (ii).

The inventive electroless cobalt plating bath is preferably held at a temperature in the range of 35 to 95° C., more preferably 50 to 90° C. and most preferably 70 to 85° C. during step (ii).

The substrate is preferably contacted with the electroless plating bath for 0.5 to 30 min, more preferably 1 to 25 min and most preferably 2 to 20 min during step (ii). The plating time may also be outside said ranges in case a particularly thin or thick metal or metal alloy layer is desired. Suitable plating time can then be determined by routine experiments.

The substrate or at least a portion of its surface may be contacted with the electroless plating bath according to the invention by means of spraying, wiping, dipping, immersing or by other suitable means.

Thereby, a metal or metal alloy layer is obtained on at least a portion of the surface of the substrate which has a glossy surface of the colour of the respective metal or metal alloy and a high optical reflectivity. In case copper is deposited onto at least a portion of the surface of the substrate a copper colour is obtained. In case a metal or metal alloy, preferably copper or copper alloy, is deposited into recessed structures of printed circuit board, IC substrates or the semiconductor substrates one or more circuitries made of metal or metal alloy, preferably a copper or copper alloy, are obtained.

It is preferential to agitate the electroless plating bath during the plating process, i.e. the deposition of metal or metal alloy. Agitation may be accomplished for example by mechanical movement of the inventive electroless plating bath like shaking, stirring or continuously pumping of the liquids or by ultrasonic treatment, elevated temperatures or gas feeds (such as purging the electroless plating bath with air or an inert gas such as argon or nitrogen).

The process according to the invention may comprise further cleaning, etching, reducing, rinsing and/or drying steps all of which are known in the art. Suitable methods for the cleaning, reducing and etching depend on the substrate to be used and have been described above for the optional pretreatment step (i.a). Drying of the substrate may be accomplished by subjecting the substrate to elevated temperatures and/or reduced pressure and/or gas flows.

Electroless plating according to step (ii) in the process according to the present invention can be performed in horizontal, reel-to-reel, vertical and vertically conveyorized plating equipment. A particularly suitable plating tool which can be used to carry out the process according to the present invention is disclosed in US 2012/0213914 A1.

It is within the scope of the present invention to use two or more electroless plating baths of the invention in a process. It is possible to first deposit a nickel or nickel alloy layer into recessed structures to form a barrier layer, then fill the recessed structures with copper or copper alloys and then provide a capping layer onto the formed copper or copper alloys with an electroless cobalt plating bath according to the invention.

It is also possible within the scope of the present invention to add one or more plating rate modifiers to any electroless metal or metal alloy plating bath in order to decrease its plating rate or to achieve any of the aforementioned advantages. Adding a plating rate modifier to an electroless copper, nickel, cobalt, copper alloy, nickel alloy or cobalt alloy plating bath results in a reduced plating rate thereof. Such plating rate modifier also increases the stability of above mentioned electroless plating baths, especially the stability of electroless copper and copper alloy plating baths. Metal or metal alloy deposits formed with an electroless plating bath containing a plating rate modifier are glossy and smooth. Any electroless metal or metal alloy plating bath in this context may be one according to the present invention or may be any other electroless metal or metal alloy plating baths suitable to deposit any of the aforementioned metals or metal alloys.

It is advantageous of the present invention that metal and metal alloys can be deposited with reduced plating rates (see Application Examples 1 to 6) which allows for the deposition of a metal or metal alloy, especially into recessed structures. Ideally, such deposition of metal or metal alloy omits the requirement of a subsequent CMP step entirely (or at least reduces the time necessary therefor). It is a further advantage of the present invention that metal or metal alloy deposits can be formed which have glossy surfaces (see Application Example 3). The plating rate modifier further allows for smooth metal surfaces to be obtained (see Application Example 3). Further, the plating rate modifiers improve the stability of electroless plating baths (see Application Examples 6 and 7).

EXAMPLES

The invention will now be illustrated by reference to the following non-limiting examples.

Substrates

The substrates used to deposit a metal or metal alloy thereon were wafer substrate made of silicon having a layer assembly thereon which consists in this order of silicon dioxide (5 to 500 nm), tantalum nitride (3 to 30 nm), tantalum (3 to 30 nm), and a final ruthenium liner layer (2 to 10 nm). Said final ruthenium liner layer is reduced with a suitable reducing agent (a solution consisting of 2 g/l of dimethylaminoborane (DMAB) as reducing agent in diethylene glycol (t=5 min, T=70° C.)).

Determination of Thickness of the Metal or Metal Alloy Deposits and Plating Rate The phosphorus content and deposit thickness were measured at 5 points of each substrate by XRF using the XRF instrument Fischerscope XDV-SDD (Helmut Fischer GmbH, Germany). By assuming a layered structure of the deposit the layer thickness can be calculated from such XRF data. The plating rate was calculated by dividing the obtained layer thickness by the time necessary to obtain said layer thickness.

Determination of Gloss

Gloss of metal and metal alloy deposits was determined by visual inspection.

Investigation of the Surface Smoothness of the Metal or Metal Alloy Layers

The smoothness of the outer surface of the metal or metal alloy layers was determined with a scanning atomic force microscope (Digital Instruments, NanoScope equipped with a PointProbe® from Nanosensors with a tip radius of less than 7 nm), scan size: 5×5 μm, scan in tapping mode. $S_Q$ values (root mean square roughness) were obtained by these measurements and are provided with the respective examples below.

Analytical Data

Mass spectra were obtained on a LC-MS device Bruker MicroTOF II (eluent A: 5 mmol ammonium formate in water, eluent B: acetonitrile, gradient system eluent A: Eluent B=95:5 (v/v), detector: ESI-TOF MS, calibrated with lithium formate and/or sodium formate (mass dependent)).

The weight average molecular mass Mw and the number average molar mass $M_n$ of the polymers were determined by gel permeation chromatography (GPC) using a GPC apparatus SECurity GPC System PSS equipped with a molecular weight analyzer RI (BI-MwA) from Brookhaven, a TSK Oligo+3000 column, and PEG and PSS standards with Mw=100 to 6000 g/mol. The solvent used was acetonitrile with 0.1 vol.-% acetic acid and 65 vol.-% 0.1 M $Na_2SO_4$.

The metal concentrations in electroless plating baths were determined by ICP-OES on a Modell Optima 3000 DV from Perkin Elmer.

Synthetic Example 1

In a glass reactor 10.55 g (117 mmol) β-alanine were dissolved in 72.74 g water prior to addition of 4.74 g (118.5 mmol) sodium hydroxide to the solution. After complete dissolution of both compounds the homogeneous and colourless solution was heated to 60° C. Within 11 minutes 11.97 g (58.6 mmol) glyceroldiglycidylether were added dropwise to the solution. Thereafter, the reaction mixture was heated to 60° C. for further 39 hours prior to cooling to 25° C. After replenishing water to yield 100 g total mass, a 25 weight percent solution of the plating rate modifier in water was obtained.

Analytical data: mass spectrum $[M+H]^+$=426.16

Synthetic Example 2

A glass reactor was charged with 8.16 mL of water. 23.47 g (78 mmol) of a 50 weight percent caesium hydroxide solution in water was dissolved slowly in the solvent. Within 7 further minutes, 10.37 g (78 mmol) leucine were added whereby a clear and colourless solution was obtained. The reaction mixture was heated to 60° C. and within 19 minutes 78 g (39.1 mmol, 50 weight percent in water, $M_n$=1000 Da) polyethylenediglycidylether were added dropwise. The reaction mixture was stirred for further 5.5 hours at the given temperature prior to cooling to room temperature. 120 g of a clear and bright yellow solution of the plating rate modifier was obtained (40 weight percent in water).

Analytical data: $M_n$=1300 Da; $M_w$=1700 Da; polydispersity ($M_w/M_n$)=1.3

Synthetic Example 3

A glass reactor was charged with 65.58 mL of water. 23.47 g (78 mmol) of a 50 weight percent caesium hydroxide solution in water was dissolved slowly in the solvent. Within further 7 minutes, 10.37 g (78 mmol) leucine were added whereby a clear and colourless solution was obtained. The reaction mixture was heated to 60° C. and within 14 minutes 20.58 g (39.1 mmol, $M_n$=526 Da) polyethylenediglycidylether were added dropwise. The reaction mixture was stirred for further 5.5 hours at the given temperature prior to cooling to room temperature. 120 g of a clear and slightly yellow solution of the plating rate modifier was obtained (40 weight percent in water).

Analytical data: $M_n$=700 Da; $M_w$=900 Da, polydispersity ($M_w/M_n$)=1.4

Synthetic Example 4

A glass reactor was charged with 30.37 mL of water. 33.0 g (110 mmol) of a 50 weight percent caesium hydroxide solution in water was dissolved slowly in the solvent. Within further 5 minutes, 14.6 g (110 mmol) leucine were added whereby a clear and colourless solution was obtained. The reaction mixture was heated to 60° C. and within 20 minutes 22.03 g (55.1 mmol, $M_n$=200 Da) polyethylenediglycidylether were added dropwise. The reaction mixture was stirred for one further hour at the given temperature prior to cooling to room temperature. Water was added in sufficient an amount to obtain 100 g of clear and yellow solution of the plating rate modifier (34.7 weight percent in water).

Analytical data: mass spectrum $[M+H]^+$=569.36 and $[M+2H]^{++}$=329.1

Synthetic Example 5

A glass reactor was charged with 30.76 mL of water. 34.2 g (114 mmol) of a 50 weight percent caesium hydroxide solution in water was dissolved slowly in the solvent. Within further 5 minutes, 15.14 g (114 mmol) leucine were added whereby a clear and colourless solution was obtained. The reaction mixture was heated to 60° C. and within 20 minutes 19.90 g (57.1 mmol) ethylenediglycidylether were added dropwise. The reaction mixture was stirred for one further hour at the given temperature prior to cooling to room temperature. The reaction mixture was diluted with 300 mL water and a clear colourless solution of the plating rate modifier was obtained (9.7 weight percent in water).

Analytical data: mass spectrum $[M+2H]^{++}$=516.36

Synthetic Example 6

A glass reactor was charged with 26.69 mL of water. 33.0 g (110 mmol) of a 50 weight percent caesium hydroxide solution in water was dissolved slowly in the solvent. Within 5 minutes, 9.41 g (71 mmol) leucine were added whereby a clear and colourless solution was obtained. The reaction mixture was heated to 60° C. and within 16 minutes 42.6 g (35.5 mmol, $M_n$=600 Da) polypropylenediglycidylether were added dropwise. The reaction mixture was stirred for one further hour at the given temperature prior to cooling to room temperature. Water was added in sufficient an amount to obtain 100 g of clear and yellow solution of the plating rate modifier (42.1 weight percent in water).

Analytical data: mass spectrum $[M+H]^+$=861.346

Application Example 1

Nickel Plating (Comparative)

Electroless nickel plating baths have been prepared by dissolving a nickel salt, various concentrations c of β-alanine, and further additives as listed below in water.

| | | |
|---|---|---|
| $NiSO_4 \cdot 6H_2O$ | 26.28 g/l, | 0.1 mol/l |
| complexing agent | | 0.255 mol/l |
| sodium hypophosphite monohydrate | 31.8 g/L | 0.3 mol/l |

The pH of the plating bath was 4.8 and it was heated to 88° C. for deposition of nickel phosphorous alloys onto substrates. Substrates were immersed into the plating baths for 120 minutes. During deposition air was purged through the plating bath. The plating rate in relation to the concentration of the additive β-alanine was determined and can be found in Table 1.

Table 1: Plating Rate of Electroless Nickel Phosphorous Plating Bath in Relation to the Concentration of β-Alanine.

| c (β-alanine) [μmol/l] | Plating rate [μm/h] |
|---|---|
| 0 | 12 |
| 10 | 12 |
| 100 | 12 |
| 1000 | 10 |

The plating rate of the nickel phosphorous bath does not change over a wide concentration range of β-alanine. Only at higher concentrations of said additive a slight reduction of the plating rate was observed.

Application Example 2

Deposition of Nickel Phosphorous Layers (Inventive)

The experiments as described in Application Example 1 were repeated with the plating rate modifier of Synthetic Example 1. The plating rate obtained in relation to the concentration of the plating rate modifier was determined and can be found in subsequent Table 2.

Table 2: Plating Rate of Electroless Nickel Phosphorous Plating Bath in Relation to the Concentration of the Plating Rate Modifier.

| c (additive) [μmol/l] | Plating rate [μm/h] |
|---|---|
| 0 | 12 |
| 10 | 10.3 |
| 100 | 7.0 |
| 1000 | 4.5 |

It can easily be seen that plating rate modifier of Synthetic Example 1 reduces the plating rate of the electroless nickel phosphorous plating bath already in very small concentrations. The reduction of the plating rate is even more pronounced at higher concentrations of the plating rate modifier.

Application Example 3

Plating Rate of Electroless Copper Plating Baths

Electroless copper plating baths have been prepared by dissolving a copper salt, various concentrations c of plating rate modifiers and bases (sodium hydroxide and caesium hydroxide), and typical complexing agents in water. The concentration of copper ions in said electroless copper plating bath was 3.25 g/l. Glyoxylic acid was used as reducing agent, formic acid was added as enhancer. The pH of the plating baths was between 12 and 13 with the base given in Table 3 and they were heated to 35° C. for deposition of copper onto substrates. Substrates were immersed into the plating baths for 20 minutes. During deposition nitrogen was purged through the plating baths. The plating rate in relation to the concentration of the additives and bases can be found in Table 3.

TABLE 3

Plating rate of electroless copper plating baths.

| Additive, base used for pH adjustment | Deposit thickness [nm] after 20 min | Surface Roughness $S_Q$ [nm] |
|---|---|---|
| Substrate (no deposit) | — | 0.72 |
| No additive (comparative), NaOH | 626 ± 9 | 140 |
| No additive (comparative) , CsOH | 337 ± 12 | 96 |
| 100 mg/l Synthetic Example 1, CsOH | 86 ± 2 | 10.97 |
| 100 mg/l Synthetic Example 2, NaOH | 109 ± 5 | 4.83 |
| 100 mg/l Synthetic Example 2, CsOH | 68.8 ± 1.1 | 10.14 |
| 100 mg/l Synthetic Example 3, CsOH | 70.9 ± 1.1 | 6.95 |
| 100 mg/l Synthetic Example 4, CsOH | 75.5 ± 1.6 | 6.75 |
| 100 mg/l Synthetic Example 5, CsOH | 81.7 ± 1.6 | 7.05 |
| 100 mg/l Synthetic Example 6, CsOH | 84 ± 3 | 6.72 |
| Mixture of Synthetic Examples 2 (10 mg/l) and 6 (10 mg/l), dipyridyl (5 mg/l), CsOH | 68 ± 7 | 6.02 |
| 10 mg/l Synthetic Example 2, CsOH | 80 ± 3 | 6.93 |

The addition of plating rate modifiers to above-described copper plating bath allows for reduced plating rate and improves smoothness of the copper deposits compared to a bath without any plating rate modifier. This is almost independent on the base used in the experiments. However, caesium hydroxide as base seems to enhance the effect of the plating rate modifier slightly. Also, small concentrations of plating rate modifiers such as 10 mg/l are sufficient to achieve said effects. The copper deposits are glossy and of a typical copper colour.

Application Example 4

Plating Rate of Electroless Cobalt Tungsten Plating Baths

A cobalt tungsten plating bath was prepared by dissolving the following components in water

| | | |
|---|---|---|
| $CoSO_4 \cdot 7H_2O$ | 12.5 g/l | 0.045 mol/l |
| $Na_2WO_4 \cdot 2H_2O$ | 16.5 g/l | 0.050 mol/l |
| Complexing agent | | 0.945 mol/l |
| Sodium hypophosphite monohydrate | 29.8 g/l | 0.176 mol/l |

The electroless cobalt tungsten plating bath was heated to 77° C. and substrates were immersed into said bath for 20 min.

TABLE 4

Plating rate of an electroless cobalt alloy plating baths.

| Additive | Thickness of CoWP layer [nm] | Standard deviation of thickness [nm] | Relative thickness [%] |
|---|---|---|---|
| No additive (comparative) | 169 | 10 | 100 |
| 100 mg/l of Synthetic Example 2 (inventive) | 126 | 9 | 74.6 |

It can be clearly noted that the plating rate modifier in the electroless cobalt tungsten plating bath allows for a reduced plating rate of the cobalt tungsten deposition.

Application Example 5

Plating Rate of Electroless Cobalt Tungsten Plating Baths 100 mg/l of Synthetic Example 1 have been added to the electroless cobalt tungsten plating bath as described in Application Example 4. Similarly, the same substrate as used in above captioned example has been used to plate upon. The relative plating rate of the electroless cobalt tungsten plating bath was decreased by 20.2% (compared to an electroless cobalt tungsten plating bath without any additive). Hence, the plating rate was decisively reduced by the plating rate modifier.

Application Example 6

Comparison of Plating Rate Electroless Plating Baths Containing PEGs and Plating Rate Modifiers The electroless copper plating baths as described in Application Example 3 (containing a source of hydroxide) were used to compare the effect of polyethyleneglycols and the plating rate modifiers on the plating rate and stability of the plating bath. Plating rate modifier of Synthetic Example 2 (inventive) and polyethyleneglycol PEG 600 (comparative) were therefore dissolved in the plating baths. Then, substrates were immersed into the plating (T=35° C., t=20 min). The plating rate obtained in relation to the additives can be found in Table 5.

TABLE 5

Plating rate of electroless copper plating bath containing PEGs and plating rate modifiers.

| | Deposit thickness [nm] | Plating rate [nm/h] |
|---|---|---|
| No additive (comparative) | 287 ± 15 | 861 ± 45 |
| 83.3 μmol/l of plating rate modifier of synthetic example 2 (inventive) | 121.5 ± 6 | 364.5 ± 18 |
| 83.3 μmol/l PEG 600 (comparative) | 255 ± 3 | 765 ± 9 |

It can be deduced unambiguously that the plating rate modifier reduces the plating rate significantly stronger than the polyethyleneglycol (PEG 600). Therefore, the plating rate modifiers provide a much more pronounced effect than those additives described in the prior art (U.S. Pat. No. 7,220,296 B1). Furthermore, the plating baths containing polyethyleneglycol was not stable and copper salts precipitated from the bath within 3 days whereas the plating bath containing the plating rate modifier was stable over the same period of time (i.e. it did not show any precipitation).

Application Example 7

Stability of Electroless Copper Plating Baths

An electroless copper plating bath was prepared as described in Application Example 3 (containing a source of hydroxide). The electroless plating bath containing different plating rate modifiers were allowed to stand for 24 h and were then inspected visually for any precipitates. Further, the remaining copper concentrations of two exemplary plating baths were investigated.

TABLE 6

Stability of electroless copper plating baths containing plating rate modifiers.

| c (additive) [μmol/l] | Visual stability after 24 h | c (Cu ions) [g/l] |
|---|---|---|
| No additive (comparative) | Substantial precipitate | 0.3 |
| Synthetic Example 2 (inventive) | No precipitate, dark-blue solution | 3.2 |
| Synthetic Example 3 (inventive) | No precipitate, dark-blue solution | Not determined |

The addition of plating rate modifiers increases the life time of an electroless copper plating bath substantially. This can already be seen from visual inspection of such plating baths after 24 h. The remaining concentration of copper ions is 10 times greater if an plating rate modifier has been added to the plating bath. A typical stabilising agent is therefore not required.

The invention claimed is:

1. An electroless plating bath for deposition of copper, nickel, cobalt or alloys thereof comprising at least one source for metal ions and at least one reducing agent characterized in that the electroless plating bath further comprises a plating rate modifier according to formula (I)

(I)

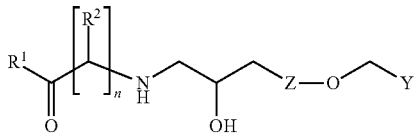

wherein monovalent residues $R^1$ to $R^2$, end group Y and divalent spacer group Z and index n are selected from the following groups $R^1$ is selected from the group consisting of —O—$R^3$ and —NH—$R^4$ wherein $R^3$ is selected from hydrogen, lithium, sodium, potassium, rubidium, caesium, ammonium, alkyl, aryl, and $R^4$ is selected from hydrogen, alkyl and aryl;

$R^2$ is selected from the group consisting of hydrogen, alkyl, alkylaryl, and aryl;

Y is selected from the group consisting of

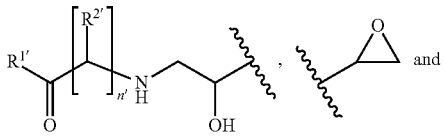

-continued

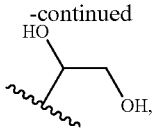

wherein the monovalent residue $R^{1'}$ is selected from the group consisting of —O—$R^{3'}$ and —NH—$R^{4'}$ wherein $R^{3'}$ is selected from hydrogen, lithium, sodium, potassium, rubidium, caesium, ammonium, alkyl, aryl, and $R^{4'}$ is selected from hydrogen, alkyl and aryl and monovalent residue $R^{2'}$ is selected from the group consisting of hydrogen, alkyl, alkylaryl, and aryl and n' is an integer ranging from 1 to 2;

Z is $$-\left[O-R^5\right]_p\left[O-R^6\right]_q\left[O-R^7\right]_r\left[O-R^8\right]_s-$$

wherein $R^5$ to $R^8$ are unbranched saturated alkylene residues wherein individual hydrogen bonded to said unbranched saturated alkylene residues in each case are optionally substituted by a functional group selected from alkyl, aryl and hydroxyl (—OH); wherein p is an integer ranging from 1 to 100, q is an integer ranging from 0 to 99, r is an integer ranging from 0 to 99, s is an integer ranging from 0 to 99 with the proviso that the sum of (p+q+r+s) ranges from 1 to 100; and n is an integer ranging from 1 to 2.

2. The electroless plating bath according to claim 1 characterized in that Y is

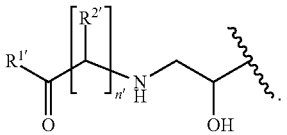

3. The electroless plating bath according to claim 1 characterized in that the residues $R^5$ to $R^8$ in the plating rate modifier are unbranched saturated $C_1$- to $C_6$-alkylene residues wherein individual hydrogen bonded to said unbranched saturated alkylene residues in each case optionally are substituted by a functional group selected from alkyl, aryl and hydroxyl.

4. The electroless plating bath according to claim 1 wherein residues $R^5$ to $R^8$ in the plating rate modifier are selected from the group consisting of ethane-1,2-diyl(—$CH_2$—$CH_2$—), propane-1,2-diyl (—$CH(CH_3)$—$CH_2$—), butane-1,2-diyl (—$CH(CH_2$-$CH_3)$—$CH_2$—) and 2-hydroxypropane-1,3-diyl(—$CH_2$—CH(OH)—$CH_2$—).

5. The electroless plating bath according to claim 1 characterized in that the plating rate modifier according to formula (I) is contained in the electroless plating bath in a concentration of 0.1 to 1500 μmol/l.

6. The electroless plating bath according to claim 1 wherein the source of metal ions is selected from water soluble copper, nickel and cobalt salts and water soluble copper, nickel and cobalt compounds.

7. The electroless plating bath according to claim 1 wherein the electroless plating bath further comprises a stabilising agent.

8. The electroless plating bath according to claim 6 wherein water soluble nickel salts and water soluble nickel compounds and the reducing agent is selected from hypophosphite compounds, boron-based reducing agents, formaldehyde, hydrazine and mixtures thereof.

9. The electroless plating bath according to claim 6 wherein water soluble cobalt salts and water soluble cobalt compounds and wherein the reducing agent is selected from hypophosphite compounds, boron-based reducing agents, formaldehyde, hydrazine and mixtures thereof.

10. The electroless plating bath according to claim 6 wherein water soluble copper salts and water soluble copper compounds and the at least one reducing agent is selected from the group consisting of formaldehyde, paraformaldehyde, glyoxylic acid, sources of glyoxylic acid, aminoboranes, alkali borohydrides, hydrazine, polysaccharides, sugars, hypophosphoric acid, glycolic acid, formic acid, salts of aforementioned acids and mixtures thereof.

11. A process for the deposition of a metal or metal alloy, comprising the steps of (i) providing a substrate;

(ii) contacting said substrate with an electroless plating bath according to claim 1; and thereby depositing a metal or metal alloy on at least a portion of said substrate.

12. The process for the deposition of a metal or metal alloy according to claim 11 wherein the process further comprises the step of (i.a) pretreating the substrate.

13. The process for the deposition of a metal or metal alloy according to claim 11 wherein the substrate is selected from the group consisting of glass, plastic, silicon, dielectric and metallic substrates.

14. The process for the deposition of a metal or metal alloy according to claim 13 wherein the substrate is selected from printed circuit boards, chip carriers, semiconductor wafers, circuit carriers and interconnect devices.

15. The process for the deposition of a metal or metal alloy according to claim 13 wherein the substrate is selected from polyimide (PI) and polyethylene terephthalate (PET) foils.

16. An electroless plating bath according to claim 2 characterized in that the residues $R^5$ to $R^8$ in the plating rate modifier are unbranched saturated $C_1$- to $C_6$-alkylene residues wherein individual hydrogen bonded to said unbranched saturated alkylene residues in each case optionally are substituted by a functional group selected from alkyl, aryl and hydroxyl.

17. The electroless plating bath according to claim 2 wherein residues $R^5$ to $R^8$ in the plating rate modifier are selected from the group consisting of ethane-1,2-diyl (—$CH_2$—$CH_2$—), propane-1,2-diyl (—$CH(CH_3)$—$CH_2$—), butane-1,2-diyl (—$CH(CH_2$-$CH_3)$—$CH_2$—) and 2-hydroxypropane-1,3-diyl(—$CH_2$—CH(OH)—$CH_2$—).

18. The electroless plating bath according to claim 3 wherein residues $R^5$ to $R^8$ in the plating rate modifier are selected from the group consisting of ethane-1,2-diyl (—$CH_2$—$CH_2$—), propane-1,2-diyl (—$CH(CH_3)$—$CH_2$—), butane-1,2-diyl (—$CH(CH_2$-$CH_3)$—$CH_2$—) and 2-hydroxypropane-1,3-diyl(—$CH_2$—CH(OH)—$CH_2$—).

19. The electroless plating bath according to claim 16 wherein residues $R^5$ to $R^8$ in the plating rate modifier are selected from the group consisting of ethane-1,2-diyl (—$CH_2$—$CH_2$—), propane-1,2-diyl (—$CH(CH_3)$—$CH_2$—), butane-1,2-diyl (—$CH(CH_2$-$CH_3)$—$CH_2$—) and 2-hydroxypropane-1,3-diyl(—$CH_2$—CH(OH)—$CH_2$—).

* * * * *